US005855747A

United States Patent [19]

Lusk

[11] Patent Number: 5,855,747

[45] Date of Patent: Jan. 5, 1999

[54] PERFORMANCE ENHANCING COATING FOR WATER HEATER

[75] Inventor: Donald I. Lusk, Mequon, Wis.

[73] Assignee: AOS Holding Company, Wilmington, Del.

[21] Appl. No.: 832,625

[22] Filed: Apr. 4, 1997

[51] Int. Cl.[6] ..... C23F 13/00

[52] U.S. Cl. ..... 204/197; 204/196; 392/457

[58] Field of Search ..... 204/196, 197; 392/457, 449, 451, 454

[56] References Cited

U.S. PATENT DOCUMENTS

| | | | |
|---|---|---|---|
| 2,459,123 | 1/1949 | Bates et al. | 204/197 |
| 2,568,594 | 9/1951 | Robinson | 204/197 |
| 2,649,532 | 8/1953 | Woodman | 212/38 |
| 2,710,833 | 6/1955 | Craver | 204/197 |
| 3,012,958 | 12/1961 | Vixler | 204/197 |
| 3,391,072 | 7/1968 | Pearson | 204/197 |
| 3,421,990 | 1/1969 | Penix | 204/197 |
| 3,542,663 | 11/1970 | Alewitz | 204/197 |
| 3,558,463 | 1/1971 | Strobach et al. | 204/197 |
| 3,616,421 | 10/1971 | MacKintosh | 204/197 |
| 3,753,888 | 8/1973 | Alewitz | 204/197 |
| 3,864,234 | 2/1975 | Wasson | 204/197 |
| 3,891,530 | 6/1975 | Alewitz | 204/197 |
| 4,035,903 | 7/1977 | Taggart | 29/458 |
| 4,071,380 | 1/1978 | Shutt | 148/6.15 R |
| 4,093,529 | 6/1978 | Strobach | 204/197 |
| 4,224,126 | 9/1980 | Bidwell | 204/197 |
| 4,420,382 | 12/1983 | Riedl | 204/197 |
| 4,647,479 | 3/1987 | Montes | 427/327 |
| 4,838,208 | 6/1989 | Stubbe et al. | 204/197 |
| 4,879,801 | 11/1989 | Stubbe et al. | 204/197 |

FOREIGN PATENT DOCUMENTS

| | | |
|---|---|---|
| 494807 | 7/1953 | Canada . |
| 24 49 022 A1 | 4/1976 | Germany . |

*Primary Examiner*—Bruce F. Bell
*Attorney, Agent, or Firm*—Michael Best & Friedrich LLP

[57] ABSTRACT

Coatings are described to improve the performance of cathodic protection systems used in water heater tanks. Semi-permeable sparingly soluble films of silicates and other organic resins protect critical areas of sacrificial anodes from concentrated usage which could sever their tank connections, yet preserve the total amount of protection available. They reduce usage of these more active anode areas and return them to service after less active ones are used up, and when the corrosion rate of exposed metal in the tank has been reduced by prolonged service, thus further extending anode life. Other coatings reduce usage of the entire anode in high conductivity waters and in electric heaters where such protection is rapidly consumed by secondary chemical reactions or absorbed by electric heating elements. These coatings also prevent complete deactivation of the anode by oxides, and bacterial interactions which generate objectionable odors. They lessen contamination of tank water by insolubilizing anode byproducts, which are then electroplated onto nearby exposed steel to passivate it, further enhancing anode life. Coatings provide a "time released" protection by exposing fresh anode metal as they dissolve. They are applied either to the anode alone, or to both anode and exposed steel, or anode and electric heating element to increase their effectiveness. Such coatings also reduce anode usage by increasing its electrochemical efficiency which then allows less metal or lower cost alloys to be used for tank protection.

25 Claims, 2 Drawing Sheets

PERFORMANCE ENHANCING COATING FOR WATER HEATER

BACKGROUND OF THE INVENTION

This invention relates to corrosion prevention in water heaters, and more particularly to improved cathodic protection systems which supplement glass coatings in protecting steel tanks. Specifically, it defines easily applied coatings for sacrificial anodes to improve their performance, which coatings can also be applied to exposed metal in the tank and electric heating elements to reduce the amount of protection they absorb.

In prior art, sacrificial anodes of active metals like magnesium and aluminum are suspended in water heater tanks to provide cathodic protection for steel not covered by glass coatings. Such exposed areas include weld seams, protruding spuds, and defects in the glass itself. Because of their reactivity, these anodes are attacked faster by hot water than exposed steel. Electrons produced are transferred to the tank wall where they polarize exposed areas and prevent their corrosion. Protection is said to be cathodic because the anode forms an electrochemical cell with the tank wall as cathode, and preferentially corrodes to protect exposed areas of steel there. Anode usage is proportional to the amount of exposed steel present. Since this is small, they remain active for many years, but many other factors also increase anode usage. Premature loss of this cathodic protection results in accelerated corrosion of steel at these exposed areas causing failure of the tank before its warranted life.

Ideally, sacrificial anodes dissolve uniformly over their length, converting all of their active metal to cathodic protection. However, in certain waters, when large amounts of exposed steel are present in the tank head, anodes are preferentially attacked at their top end near the tank connection because of the closeness of this exposed steel and metal of fittings. This causes "necking down" there which can sever the tank connection before the active metal is completely used. The fitting holding the anode affects necking most because it is closest to the active anode metal. This problem is most severe in low conductivity water where it is difficult to draw protection from the end of the anode furthest from this connection for the large amount of exposed steel in the tank head.

Another problem of conventional anodes is their excessive usage in certain high conductivity waters. Here high levels of dissolved salts accelerate hot water attack of the anode metal, producing more electrons than needed for corrosion protection. These dissolved salts also facilitate interaction of anode electrons with surrounding water to form hydrogen gas, rather than being transferred to the tank wall for corrosion protection. Both these effects cause premature exhaustion of the anode. They also reduce its electrochemical efficiency which is the amount of usable protection produced per gram of active metal, so that larger anodes are needed for a given tank life.

Efficiency of anode metals is also reduced by formation of inert surface films. These impermeable barriers prevent interaction of water and active metal at certain areas of the anode, reducing the rate that protection is produced. They can even totally deactivate the anode. Such inert films are formed by accumulation of reaction products such as insoluble oxides on the anode. In other cases films are formed which reduce the electrochemical activity of the anode below that of exposed steel, so that the tank wall preferentially corrodes to protect the anode film (reversals). A related problem is the low efficiency of anodes in electric heaters caused by the proximity of highly charged, heating elements whose strong electronic fields draw off most of their electrons, shortening anode life and reducing the protection available for the rest of the tank.

Other problems with conventional anodes are the objectionable nature of their byproducts. Bad odors are produced in some sulfur containing waters when the anode interacts with anaerobic bacteria formed during heater operation. The more active the anode metal, the greater the possibility that odors will form. Unfortunately these more active metals provide the best cathodic protection. Anode operation also adds trace amounts of heavy metal ions to the tank water. When anode usage is high, such as in aggressive waters, these additions become more significant, and could have possible toxicological effects. For example, aluminum ions have tentatively been linked to Alzheimer's disease. Reducing this type of contamination could become a greater issue as stricter regulations on water purity are enacted.

SUMMARY OF THE INVENTION

Therefore, the object of my invention is to define inexpensive, easily applied coatings for water heater anodes which modify their behavior enough to solve or reduce the above problems. This is a radical departure from conventional practice which usually coats cathodes of such electrochemical cells. Anode coatings must leave enough residual protection to prevent accelerated corrosion of exposed steel in the tank, or even trace corrosion of fittings which might discolor the water. To minimize costs they should require minimal surface preparation and curing cycles, yet form sparingly-soluble films over the anode surface which remain for an appreciable part of tank life. Byproducts produced by coatings must be nontoxic and approved by the EPA for potable water.

It is my further object to provide coatings for use on selected parts of the anode to uniformly distribute chemical activity over its entire surface, and especially away from the head area where tank connections are located. In this way coatings eliminate necking which can prematurely sever the anode's connection. Coatings should be effective even in low conductivity water, or in close proximity to exposed steel, which conditions promote necking. It is especially required that these coatings do not reduce the amount of protection available from the anode, since this would reduce tank life and increase anode costs. Thus, coatings should not permanently eliminate protective activity of the upper anode, but only temporarily distribute it to lower regions. As they dissolve, the upper end again becomes fully active. Coatings will also be provided to almost totally deactivate the upper part of the anode and then return it to service at a later time when they dissolve, and after less active anode areas have been used up in service.

A third object of my invention is to provide more permeable coatings for the total anode which reduce its activity in high conductivity water, yet generate enough residual activity from moisture transfer through them to protect all exposed steel. They should preserve this excess activity for future use, and so extend anode life in these aggressive waters. Such coatings should also prevent interactions with anaerobic bacteria which are responsible for objectionable odors, and formation of oxide layers which deactivate parts of the anode. They should promote transfer of electrons to the tank wall, and reduce their interactions with hot water which cause secondary chemical reactions such as generation of flammable hydrogen gas. In this way my coatings improve the anode's electrochemical efficiency, which then extends its life by a third mechanism.

Another object is to provide a range of coatings for specific applications. Less expensive and easier to handle types will be defined for various production conditions. Some of these act by forming semi-permeable films, while others interact with the anode metal to form semi-continuous films of reaction products which are less soluble than the coatings themselves for longer performance. These reaction layers moderate anode activity in the same way that coatings do, preventing the interaction of anaerobic bacteria to eliminate objectionable odors. They also retain enough residual activity to protect all parts of the tank. Differences in cure schedules, safety precautions and environmental contamination between coatings then determine which type should be used in a given situation.

A fifth object of my invention is to define coatings to improve the efficiency of anodes in electrically fired water heaters. They should reduce anode activity, so that strong electric fields of nearby heating elements do not drain off protective electrons. Coatings should be applicable to both anodes and elements, if possible, to reduce the interaction of these components for maximum anode preservation. They should form heat stable films on electrical elements which inhibit their ability to discharge protection from the anode. They will thereby increase the life of anodes in this difficult application in a second way, and, thereby, the amount of usable protection that is available for the tank. In this way, efficiency of these anodes is increased, so that smaller amounts of active metal are required for a given tank life.

A final object of my invention is to simplify application of these coatings in production and maximize their effectiveness. Partial anode coatings should require no lengthy cure cycles or complex surface preparations, and should not permanently deactivate the anode area they cover. They should not add any objectionable contamination to tank water even where they are subjected to concentrated heat such as on flues or electric elements. Coating modifications should also be available to apply to both anodes and exposed steel to reduce the chemical activity of both these areas, and thus insure maximum preservation of the anode in difficult service conditions, such as the high dumping rates of commercial heaters. These modifications should also be applicable after tank construction is completed to extend protection to all welds, spuds and fittings which have been added during manufacture. They should also optimize protective action by electroplating passivating films of anode/coating reaction products on exposed steel to reduce corrosion rates there.

Objects and advantages other than those set forth above will become apparent to those skilled in the art upon review of the following detailed description of the invention.

Before these embodiments are explained in detail, it is to be understood that the invention is not limited in its application to the details of construction or arrangements of components set forth in the following descriptions and drawings. The invention is capable of other embodiments and of being practiced or being carried out in various ways. Also, it is to be understood that the descriptions and terminology used herein are for the purpose of illustration and should not be regarded as limiting.

DETAILED DESCRIPTION OF A PREFERRED EMBODIMENT

Figure 1:
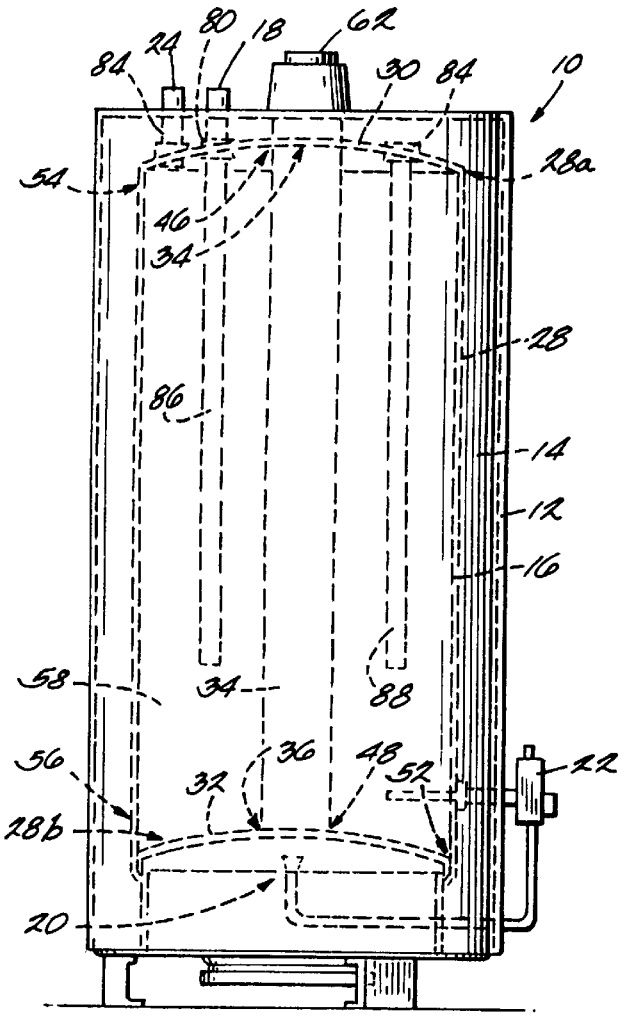
FIG. 1 is a side view of a water heater showing the various features of this device.

FIG. 1 shows a water heater 10 detailing the areas of exposed steel which cause necking problems during anode operation. It includes a cylindrical outer shell 12, a tank 16 (further described below) supported inside this shell 12 and surrounded by insulation 14. An inlet 18 for delivering cold water into the tank 16 and an outlet 24 for discharging it are located in the tank head 30. The tank also includes a means 20 for heating the water. In the illustrated embodiment, this is a gas burner, supported below the tank 16 in heat exchanging relation therewith. In other embodiments (as FIG. 5), heating is by an electric element mounted in the tank wall.

Figure 3:
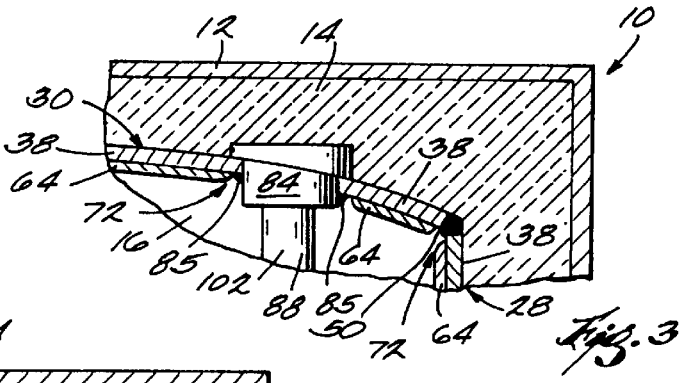
FIG. 3 is an enlarged portion of FIG. 2, showing details of my invention.
Figure 4:
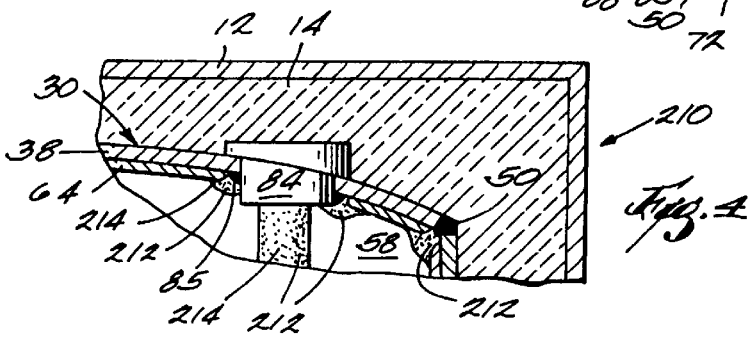
FIG. 4 is a view similar to FIG. 3, giving an alternative embodiment of my invention.

In the illustrated embodiment the tank 16 is a closed, upright cylinder including a sidewall 28 with an upper portion 28*a* and a lower portion 28*b*. The tank 16 also includes a head 30 and a bottom 32. A flue 34 extends through the tank. The tank 16 is composed of an outer layer 38 of corrodible material as shown in FIG. 3. In the illustrated embodiment, this material is carbon steel which is welded along the following seams: 46 (FIG. 1) between the head 30 and the flue 34, 48 (FIG. 1) between the tank bottom 32 and the flue 34, 50 (FIG. 3) between the head 30 and the sidewall 28, and 52 (FIG. 1) between the tank bottom 32 and the lower portion 28*b* of the sidewall 28. At its lower end, the flue 34 is positioned above and communicates with the combustion chamber containing the gas burner 20.

The tank includes an inner coating 64 of material covering and protecting the carbon steel outer layer as shown in FIG. 3. In the illustrated embodiment, this lining material is glass. So-called "brush-back areas" 72 (FIG. 3) are defined along the opposite sides of each weld seam 46, 48, 50 and 52 where glass 64 has been removed to expose the carbon steel 38 and permit its welding. Thus, carbon steel of these brush-backs and the welds themselves are exposed to hot water in the tank 16 which causes corrosion and can lead to tank failure.

The head 30 also has openings therein with corresponding spuds or fittings 80, 82 and 84 (FIG. 1) mounted in them and extending into the tank. The fitting 80 is connected to the water inlet 18 and supports a dip tube 86 for delivering cold water from the inlet 18 into the interior 58 of the tank. The fitting 82 is connected to the water outlet 24 and serves as a communication with the interior 58 to discharge hot water from the tank 16. The fitting 84 supports a sacrificial anode 88 (described below) which extends into the tank. The fittings 80, 82 and 84 consist of corrodible material which, in the illustrated embodiment is carbon steel. The fittings 80, 82 and 84 are welded to the head 30 at respective weld seams 85 (FIG. 3) and additional brush-back areas 72 are defined along them.

The anode 88 cathodically protects the exposed carbon steel along weld seams, in the brush-back areas, and in the fittings from corrosion by the hot water contained in the tank. It also protects carbon steel exposed through small defects which may occur in the glass lining 64. Corrosion here is more serious and could cause leaks in the wall and failure of the tank. The anode 88 provides this cathodic protection to supplement the barrier properties of the glass liner, 64. It is made from a metal more electrochemically active than carbon steel so that corrosion protection can be generated for exposed steel of the tank. In the illustrated embodiment, the anode 88 is a rod having (see FIG. 2) upper and lower ends 92 and 94. The upper end 92 is mounted in the fitting 84, and the rod 88 extends downwardly therefrom. The length of the anode rod is about two thirds of the distance between the head and bottom of the tank. Although other suitable anodic materials can be used such as magnesium and zinc, in the illustrated embodiment, the anodic material is aluminum.

Many configurations of these components are possible. The common problem is that large amounts of exposed steel are present in the top head close to the anode's attachment to the tank. In low conductivity waters these spuds, welds and brush-backs draw most of their protection from the top of the anode, thinning it (necking), and weakening its connection to the tank. If it is completely severed by such concentrated usage, protective electrons cannot flow to the tank wall to prevent corrosion of exposed steel there, and failure soon occurs. My invention provides either partial or total coatings for the anode to reduce its activity in this area and limit such concentrated attack. Byproducts from my coatings and the anode itself are also electrically plated onto areas of exposed steel to passivate them, further reducing anode usage. These exposed areas may also be coated along with the anode using other embodiments of my invention which passivate them more efficiently, while simultaneously reducing anode activity.

Figure 2:
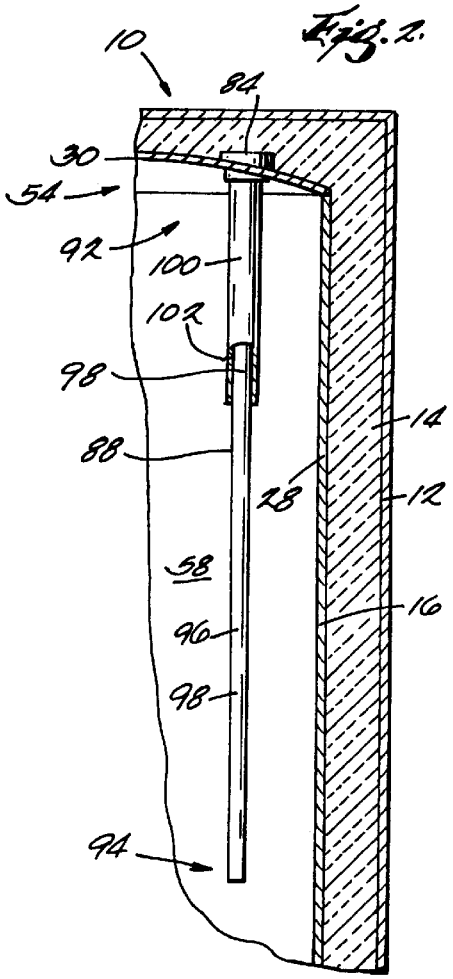
FIG. 2 is a sectional view of the water heater in FIG. 1, illustrating other features of my invention.

As best shown in FIG. 2, the anode rod 88 includes both an uncoated portion 96 and a coated portion 100. In the illustrated embodiment, the uncoated portion 96 consists of about the lower two thirds of the rod 88. In different embodiments, different portions remain uncoated. The uncoated portion 96 exposes the active metal of the anodic material 98 to hot water attack so that it can generate protection for exposed steel in the tank. The coated portion 100 of the anode consists of about the upper one third of the rod 88 and includes its upper attachment, spud and fitting. In other embodiments, a different portion or even the entire rod can be coated. The coated portion 100 includes an inner layer of the anodic material 98, an intermediate layer of anode/coating reaction products, and an outer layer of cured coating 102. The coating 102 over the anodic material 98 is of sufficient thickness to moderate or substantially reduce the rate of water attack on this portion of the rod (88). Thus, the coating 102 effectively "deflects" such electrochemical attack away from the top area to the uncoated lower portion 96. This prevents concentrated usage of the upper area as occurs with conventional anodes because of the proximity of large amounts of exposed steel in the tank head.

Preferably, the coating 102 consists of a material which is semipermeable to water and thus permits only a relatively small amount of moisture to interact with the anodic material 98. This substantially reduces the rate of galvanic attack on the anodic material 98 in the coated portion 100 and transfers most of the activity of the anode concerned with protecting exposed steel to its lower, uncoated portion. Thus, anode material in the coated portion is conserved for use at a later time after the lower part has been used up. However, some galvanic protection is still available from the coated portion by virtue of its semipermeable nature to supplement that of the lower anode in case the latter is insufficient to prevent corrosion in very aggressive waters. This also gives the coating process some flexibility. The exact extent of the coated area is not critical since some residual protection can still be drawn from it. The coating on the anode top can also be made thicker to more completely inhibit activity of this area, so it is returned to service at a much later time when the bottom, uncoated part of the anode is almost used up and the corrosion rate of exposed metal in the tank is greatly reduced by prolonged service. This extends anode life by a second mechanism.

The coating 102 preferably also is sparingly soluble, and thus slowly dissolves during extended contact with hot water, over a period of several years. This substantially delays galvanic attack on the anodic material 98 in the coated portion during this time. As the coating 102 dissolves, fresh anodic material 98 is exposed and provides increased electrochemical activity in the coated portion 100 to replace that used up in the lower uncoated portion. Dissolution of the coating 102 thus gives a "time release" action which provides for continuous operation of the anode and prevents concentrated usage of its upper end at its connection to the tank until the lower areas have been nearly used up. If necking and anode break-off should still occur at the top area, much less of the active anode will be lost and at this later stage in service, so that tank failure will be postponed past warranty limits. However, it is unlikely such concentrated use will occur then since exposed steel in the head has already been passivated by prolonged protection from the lower anode, and thus needs less protection from the upper anode to maintain its passive, corrosion resistant state.

The coating 102 also preferably interacts with the hot water and forms byproducts that are deposited along with metal ions from the anode in passivating films on nearby exposed steel. These films reduce the corrosion rate of this exposed steel, and thus limit the need for protection from the anode. Such films are electrochemically plated on exposed steel under potentials generated by the anode itself. In another embodiment formation of such films is enhanced by spraying the coating material plus a filler of fine particles of anode metal on both exposed steel and the anode in a single production step after tank construction. This places byproducts of coating and anode usage closer to areas of exposed metal which are otherwise some distance from the anode where electrolytic plating is less efficient and retarded by tank draw off of water containing these byproducts. Instead they are juxtaposed and easily plated out on exposed metal.

In my preferred embodiment, the coating 102 consists of a dried film of hydrolyzed alkyl silicate prepolymer. Commercial forms of this material, such as the Silibond products materials, can be used. The coating is applied in any suitable manner, such as by dipping or spraying the anode metal with a solution of the alkyl silicate material 102 which has been made by dissolving it in a compatible solvent, such as ethyl alcohol. The amount of silicate material in the coating solution typically is between 10% and 20%, alkyl silicate as $SiO_2$ to the total weight of the solution. The coating can be applied in any suitable thickness, but typically is between 0.1 and 1.0 mil thick. It is cured in a suitable manner, such as by drying at atmospheric conditions for a period of 30 min. The silicate prepolymer readily reacts with atmospheric moisture to form a nearly insoluble film, thus eliminating the need for extra process steps to heat cure it. The extent of coating determines how much anode will be preserved for future use after the coating dissolves. Its thickness controls how much residual activity is left and when the coated area will be returned to full activity. In one test, initial protective currents from anode to tank were reduced from 3.8 ma to 2.3 by such partial coatings, showing a 40% effect on anode activity. Such currents rapidly decrease as tanks become polarized, masking activity differences between anodes. After 3 weeks in pressurized, 200 degree F. seawater, no necking was observed on a coated anode, but was pronounced on the uncoated one.

The coating when so cured forms a very slightly soluble film of glassy, hydrated silica over critical areas of the anode and its spud/fitting which partly insulates them from each other and reduces their chemical interactions with water. This film is only slowly dissolved away by hot water. It also forms traces of even less soluble anode metal/silicate reaction products which further protect the anode. Both these intermediate and outer layers are semipermeable and sparingly soluble. They react with water to form byproducts, such as soluble silicates, metal oxides and hydroxides, which are deposited as passivating films on exposed steel under electrochemical potentials between the anode and tank. Because the silicate coating is semipermeable and allows some galvanic attack on the underlying anodic material, its thickness and extent on the anode are not critical and thus require minimal production control, compared to an impermeable coatings like epoxy resins, which eliminate all protective activity if not properly applied and so permanently deactivate that part of the anode they cover.

The alkyl silicate material 102 is selected from the group consisting of: methyl silicate, ethyl silicate, propyl silicate, and their active prepolymers. Preferably, the alkyl silicate material 102 is ethyl silicate. More preferably, the ethyl silicate is H-6 ethyl silicate (Silibond Corporation; Weston, Mich.). The alkyl silicate material is admixed with ethyl alcohol, and applied over the anodic material. It cures with the moisture present in air to a toxicologically inert product, hydrated silica, which adds no objectionable contamination to tank water. The cured silicate film may contain one or more additives, such as bulking agents, clays, or diatomaceous earth powders which can be used to increase thickness or crack resistance of the coating. Water soluble particles can also be added to the coatings to increase their permeability for use as full anode coatings, so that sufficient protection can be generated to prevent excessive corrosion of exposed steel in the tank.

Advantages of this embodiment are that coatings described are approved by the EPA for use in potable water. The alkyl component is converted to ethyl alcohol during cure and is easily evaporated from the thin films formed. The silicate forms a hydrated network of silicon dioxide (purified sand) which is biologically inert. The organic coatings given in the next part are hydrolyzed to low molecular weight starches and sugars with no toxicological effects. In contrast, conventional coatings of epoxy resin contain hazardous aromatic components which could be extracted by the hot water during prolonged service. They are also easily decomposed to toxic byproducts when exposed to high temperatures present on electric heating elements or top flue areas which use large amounts of anode protection. In contrast my silicate coatings are stable to these temperatures. If trace decomposition does occur, only nontoxic silicon dioxide is formed.

Another advantage of my invention is that silicate coatings only temporarily deactivate critical areas of the anode, but do not permanently affect their performance or use up any of their protection as would totally insulating coatings. Thus they can be readily used on production water heaters without danger of harming anode performance. Their semipermeable nature assures some protection is available through them. The uncoated portion still provides sufficient protection for the tank until the coatings naturally dissolve. These coatings are well-known in the formulation of corrosion resistant paints where they hold active pigments together without insulating them as would conventional organic binders. They also distribute the activity of these pigments uniformly over the painted surface and capture reaction products produced by pigments to form a barrier film which further protects the underlying metal.

In a second embodiment, the coating is formed by an aqueous solution including one or more alkali metal silicates which is selected from the group consisting of: sodium, potassium or lithium silicates and combinations thereof, admixed with sodium or potassium hydroxides to render them soluble. Also usable are the usual industrial modifications of these metal silicates, with different ratios of silicon dioxide to metal oxide and different silicate concentrations. It is believed that these solutions form their deactivating coatings by interaction with the anodic material to form a film of reaction products over it which reduces galvanic attack. The reaction product is a thin, porous film of a sparingly-soluble salt of anodic metal silicate. The aqueous solution of metal silicate can include one or more additives, such as bulking agents, clays, or diatomaceous earth powders to increase the coating thickness or reduce its brittleness. In this case the top layer of aqueous silicate coating must be heat cured to a slightly soluble form, or the excess unreacted silicate solution washed away to leave its layer of reaction products with the anode material as the deactivating coating.

In this embodiment of my invention, the total activity available from the anode is somewhat reduced by the reaction of active metal and silicate solution on its surface. The aluminum anode is coated by dipping into a hot, diluted solution of "N" grade sodium silicate for 30 to 60 seconds. The coated anode is then cured at 180 deg. F. for 16 hours to insolubilize unreacted silicate left on the surface. Electrochemical potentials of 5356 aluminum anodes coated in this way were reduced from 740 to 680 millivolts, showing my coating's ability to moderate protective activity. After 2 months of exposure to 180 F. water, this surface remained bright with no signs of oxide formation, yet cathodic protection continued to protect exposed steel. In contrast, uncoated anodes turned dark gray and lost much of their activity. This shows my coating's ability to prevent unwanted surface reactions which totally and permanently deactivate the anode.

It also shows its ability to block interactions with anaerobic bacteria which form objectionable odors, as will be described later.

Advantages of this embodiment are that only water based solutions are used, eliminating discharge of organic solvents into the air as with alkyl silicates. Reaction product films are less soluble than those of pure silicates and so have a longer affect on anode performance. Further, they are more permeable, and so allow a higher amount of protection to be generated through them, so that the total anode can be more safely coated. The soluble metal oxide silicates produced by water interaction with the coating have more corrosion inhibiting properties on exposed steel of the tank. Unfortunately, they are also less acceptable for potable water. Cure conditions are also more difficult and coating solutions more hazardous to use. Some anode material is also consumed by the reaction.

In a third embodiment, the coating can be a suitable sparingly-soluble and permeable organic material such as selected from the group consisting of: polysaccharides, starches and high molecular weight condensation polymers. Suitable condensation polymers are cellulosics, polyols and polyesters. These organic resins form coatings that are permeable to moisture but, unlike the silicate coatings, they do not form longer-lasting films of reaction products with the anodic material. Advantage of these organic films are that byproducts of reaction with hot water are soluble sugars, and carbohydrates with no toxicological activity. They are applied from neutral, water-based solutions to minimize safety and environmental problems possible with the other coating classes.

In a fourth embodiment, the entire anode rod 88 may be protected with one of the coatings given above 102 for use in very aggressive waters where fast anode dissolution by hydrogen evolution is favored over slower reactions that generate galvanic protection. Such fast reactions use up anode material before its designed life, causing premature tank failure. Coatings prevent these fast reactions by moderating anode activity, thus saving more of it for corrosion protection. The sparingly-soluble nature of the coatings permits them to slowly dissolve away, exposing new anode material to replace that used up by the aggressive water. Thus, protection is continuously produced by this "time release" effect for longer periods of time than for conventional anodes which are quickly consumed by such aggressive water. In this case, only small amounts of protection are produced by the semi-permeable nature of the coatings, so that most of it can be preserved for future use. This means that some corrosion may occur on exposed steel in the tank. However, anode life is substantially extended to control this problem over the long term. This effect maximizes anode life more than expected because the corrosion rate of exposed metal in the tank is reduced by protection generated through the coating during the early stages of service, so that less protection is needed as the coating dissolves.

Coatings anticipated for use over the entire anode are any of those already described. In particular, the alkyl silicates are recommended because they do not consume any of the anode material and are so easy to apply. Aqueous alkali metal silicate conversion layers, however, are less soluble and thus effective for longer periods. However, they use up some anode material in forming their protective films. Aqueous alkali metal silicate coatings are also more permeable and so generate more protection through them for use as total anode coatings. The higher percentage of anode metal/coating byproducts in the intermediate layer of such coatings is also more effective in preventing oxide and odor formation.

Another advantage of such total anode coatings is they improve anode metal efficiency in these cases. Efficiency is the amount of usable protection produced per weight of anode material. It directly influences the size of the anode needed for a specific tank life and thus cost of cathodic protection. Surface reactions such as oxide formation and hydrogen evolution are responsible for the low efficiencies of certain anode metal alloys because they use electrons produced by the anode for non-protective reactions. By limiting these non-protecting reactions, coatings increase efficiency of these alloys, and could permit the use of smaller, less expensive anodes, or easier to process, low-efficiency alloys which form such oxide films more readily.

A third advantage of total coatings is they also inhibit other unwanted surface reactions. They prevent formation of insoluble oxides on the anode which permanently and completely deactivate it. By this effect, coatings further enhance anode life and also increase its efficiency. Besides hydrogen formation which uses up anode metal in non-protective reactions, such surface oxides are the chief cause of poor efficiency of certain alloys. Objectionable odors are thus also inhibited by these coatings since they are also caused by surface reactions of the anode with anaerobic bacteria found in certain sulfur containing waters. My coating prevents such interactions and odors. After silicate films dissolve, the remaining layer of adherent active metal hydroxide byproducts collected by them on the anode surface then continues to reduce odor formation and surface reactions by moderating anode activity.

A final benefit of fully coated anodes is to reduce contamination of tank water by dissolved metal ions produced during anode operation, which could be perceived as affecting water quality. By minimizing anode activity, fewer metal ions are released into tank water, reducing contamination. Also, as the anode dissolves to protect exposed steel, metal ions that do form are contained by the coating, rather than being discharged into surrounding tank water. They are held in close proximity to the anode, where they interact with hydroxyl ions also formed during its operation, and are, thereby, converted to insoluble hydroxides, which are similarly retained by the coating and reduce contamination a second way. Even after the coating is dissolved away, these metal hydroxide compounds remain attached to the anode to further retain other metal ions formed there. Byproducts of dissolution of this coating are also inert, and acceptable compounds for potable water and so add no other form of contamination to tank water. Anode metal ions and coating byproducts which escape this mechanism are then electrolytically plated as insoluble films on nearby exposed metal, and so permanently insolubilized there.

In a fifth embodiment, the silicate coating further includes particles which both moderate electrochemical activity of the anodic material, and improve passivation of spuds and welds in the tank head. These particles are selected from the group consisting of: metal oxides, inorganic compounds or active metal particles and combinations thereof. The coating and particles together form a more complete barrier on anodes and exposed steel than the alkyl silicate alone. The metal particles rapidly interact with hot water to form dense reaction products which are held in place by the silicate film. These plus similar byproducts from the silicate coating are also electrolytically plated onto nearby exposed steel. These deactivate the anode and passivate steel better than the unfilled coatings, yet add no new materials or reaction products which could harm anode performance or contaminate tank water, since anodic metal particles are identical to the anode metal itself.

Reaction products formed are identical with those of previous unfilled coatings and passivate exposed steel similarly. However, they are more easily electroplated onto these areas because of their close contact with the steel there. The formation of passivating and barrier films is thus maximized, especially under service conditions which retard electroplating such reaction products. These include commercial heaters where high rates of water turnover reduce plating time, and in low conductivity waters where anode/tank interactions are limited to small distances. Such films reduce corrosion rates of these exposed areas by their passivating effects of silicate reaction products, thereby further increasing anode life. Reaction products of anode metal particles also form physical barrier layers over exposed metal to reduce corrosion, extending anode life even more. Thus the mode of action of my coatings on exposed metal of the tank is different than conventional and corrosion paints.

Other advantages of such metal filled coatings are that they are applied to both anode and top head steel in a single operation to improve the performance of both these structures. This eliminates separate coating operations for each component. Since coating is done after tanks are welded together and spuds inserted, it assures that all exposed steel added during construction is fully coated to maximize anode preservation. Coatings are applied with long spray nozzles through the spud openings. Other advantages are that my coatings do not require careful surface preparation for their effects. Conventional anticorrosion paints must be applied to blasted surfaces for long-term performance. They must be thick enough to prevent moisture permeation, and provide enough active metal for protection over the life of the tank. In contrast, my invention uses very thin layers, which do not require strong surface adherence or continuous films. Instead, particles of my coatings quickly dissolve in hot water, forming reaction products which are electrically plated onto the steel under them to polarize and passivate it by potentials already present in the tank. Thus, my coatings are not effective by themselves, but only assist the function of the central anode. In this way they are different from conventional anode particle coatings typically used to help protect exposed steel from corrosion.

Figure 5:
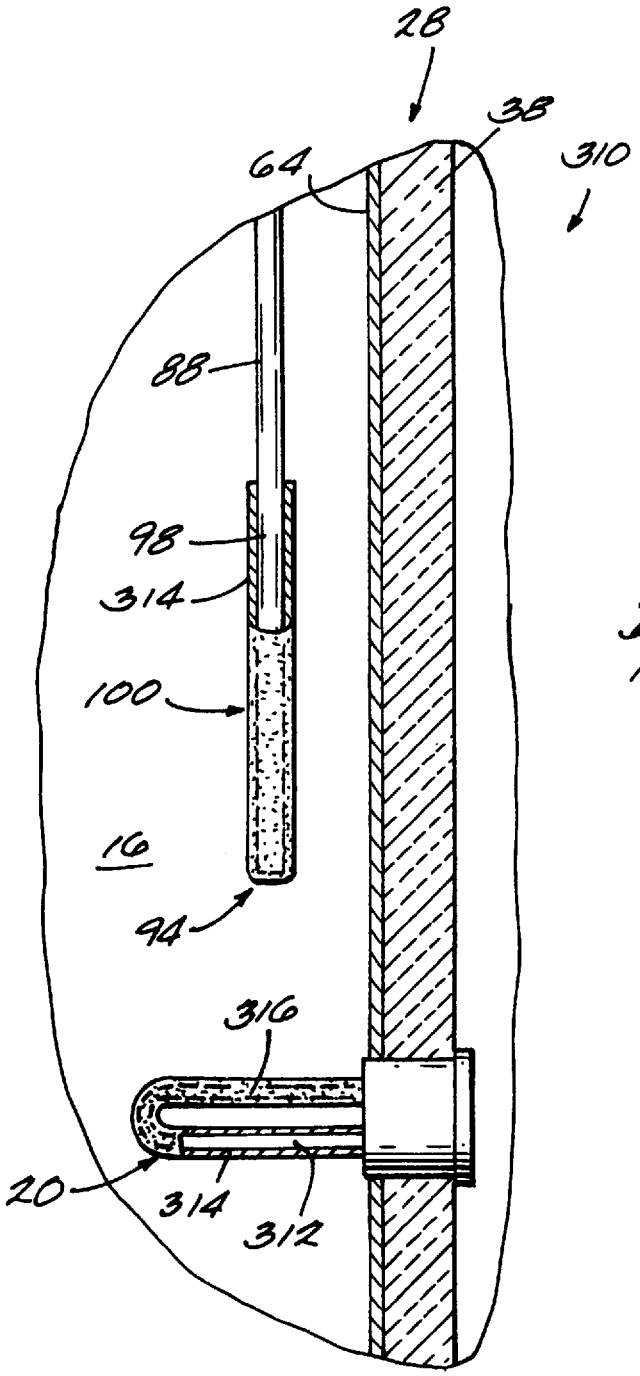
FIG. 5 is a partial view of an electric water heater with yet another embodiment of my invention.

Such metal powder filled coatings also may be used in a sixth embodiment as illustrated in FIG. 5. A water heater is shown here with an anode rod 88 consisting of coated and uncoated areas (100, 98). It is identical to that in FIG. 1 except the means 20 for heating the tank 16 is an electric element 316 composed of an inner layer 312 of electrically conducting metal such as inconel, copper or galvanized steel. The coating then forms an outer layer 314 on both the element 20 and the anode 88, which partially insulates them from each other. In this case, the coating is also applied to bottom part 94 of the anode because it is closest to the heating element, and thus selectively insulates it from the strong electric fields surrounding this member. Here the coating on the heating element is used primarily to insulate it and reduce the amount of cathodic protection it electrically absorbs, thus increasing the anode's life in yet another way.

Another advantage of such silicate coatings when used on electric heating elements is that they are heat stable and any byproducts formed during exposure to high temperature surfaces are nontoxic. Ethyl silicate films decompose only at very high temperatures and even then form only byproducts of finely divided silica (sand) which is toxicologically inert. In fact, such colloidal silica is reported to be a corrosion inhibitor and glass coating preservative. In contrast, commercial insulating coatings such as epoxies contain potentially toxic components like aromatic amines which, under even moderate heating are decomposed and released from the coating into surrounding water. Heat from electric elements or flue areas can thus easily decompose the epoxy coatings into these toxic byproducts. Thus, coatings of my invention can also be used on hotter parts of the water heater tank such as the bottom wall near the burner or at the top flue weld to passivate these areas as previously described.

In a seventh embodiment, the coating and additives serve to activate or otherwise increase electrochemical activity of certain anodic materials which do not produce enough protection to prevent corrosion of exposed steel. Such materials include certain alloys of these metals which form oxides that slowly halt their activity or surface layers which lower or even reverse their potentials in hot water. The coating and its additives act to prevent formation of such layers by preventing contact of oxygen dissolved in the water with the anode surface or decomposing them as they are formed. This embodiment permits the use of such alloys which are usually less expensive and easier to process for anode materials in water heater tanks. In these cases, the bottom part of the anode is coated to direct usage there and the top part is left uncoated, so that the connection to the tank is naturally protected from necking by its own oxides. Examples of these systems are the use of silicate coating with high purity aluminum powder to activate low cost 1350 aluminum alloy anodes or low purity zinc anodes. In the first case, insulating oxides are dissolved and inhibited by the coating, while in the second, electronic layers which reverse protection flow are decomposed.

In an eighth embodiment, the exposed steel areas of the spud and fittings, especially the one holding the anode material itself, 84, are coated with an impermeable barrier of insoluble material to prevent its interaction with the anode. Since this spud is nearest the anode, it has the greatest effect on necking. Specific materials recommended are silicone and certain epoxy coatings approved for potable water because of their easy cure, insulating qualities and absence of toxic components. Such coatings, however, do not dissolve away during prolonged hot water contact, so the portion of the anode they cover is not recoverable as are areas covered by earlier silicate coatings. Thus, the coated area should be as small as possible. Such abbreviated coatings do not completely eliminate necking but only slow its rate of attack in proportion to the extent they separate exposed steel from active anode material.

All the embodiments of my invention presented here have the common objective of improving anode performance through the use of inexpensive, easily applied coatings which modify but do not totally eliminate its protective activity. These coatings improve anode performance in some 22 different ways. They increase anode and, therefore, tank life by 8 novel mechanisms. They prevent necking and premature break-off by reducing the activity of the anode top at its tank connection without permanently deactivating the area they cover. Their time release behavior increases life by using less active anode areas to protect the tank first, and then more active ones after prolonged service has partially passivated exposed metal. This emphasizes protection of the more critical areas of the tank wall in contrast to exposed metal of fittings in its head. It also distributes anode activity more uniformly along its length. Coating and anode byproducts are electrolytically deposited on areas of exposed metal in the tank, especially nearby fittings, to reduce their interaction with the anode and also their corrosion rate. Anode reactivity is also reduced in electric heaters in areas near heating elements to prevent their electric fields from absorbing cathodic protection which they do not need. Coating byproducts are also deposited on these heating elements to insulate them and further limit this protection drain. Full anode coatings reduce its activity in very aggressive waters which then consume such excess protection in non-protective, secondary chemical reaction such as hydrogen gas evolution. These coatings also prevent oxide formation on anodes which reduces their electrochemical efficiency and hence their usable life.

In addition to extending anode and tank life as detailed above, my coatings also improve anode performance by some 14 other mechanisms. By moderating anode activity, they reduce odor causing reactions in high sulfur water. They insolubilize metal ions produced by anode operation, reducing heavy metal contamination of tank water. This also reduces aluminum precipitates which can cloud tank water. By improving anode efficiency they permit smaller anodes to be used. They also permit use of less active, lower cost metals in anodes by preventing oxide formation on them or activating alloys that naturally have such surface oxide layers. They contain no toxic byproducts and cure in air with no additional process steps needed to form slightly soluble coatings. They are extremely heat stable, and so can be used on hottest parts of the heater such as electric heating elements and flues to reduce corrosion and anode usage. They permit single step coating operations of both anodes and exposed metal for maximum effectiveness in extending anode life. Such "one step" coatings can be applied after tank construction is complete to protect fittings and welds added in the last stages of production. Their semi-permeable nature means some protection occurs through them, so that the exact amount of anode covered is not critical, simplifying production, and tank performance cannot be harmed by them since they eventually are dissolved. No special surface preparation is needed for these coatings on either anodes, exposed metal or electric heating elements of the tank.

What I claim is:

1. A tank for a water heater, said tank comprising:

a tank wall defining an interior, said tank wall including corrodible metal having an interior surface, said tank wall including a glass lining adjacent said interior surface to protect said corrodible metal from corrosion by hot water in said interior, said tank wall including areas of corrodible metal which are exposed to the hot water in the interior, said tank including an inlet for introducing cold water into said interior, said tank including an outlet for discharging hot water from said interior, said tank including a fitting mounted in said tank wall, said tank including an anode mounted in said fitting for cathodically protecting said exposed areas of corrodible material from corrosion by the water, said anode having a semi-permeable, sparingly soluble coating over its top one third, adjacent to, and including its connection to said tank, to temporarily reduce, but not totally eliminate electrochemical activity at this critical area, and return said coated part of the anode to full activity at a future time after said coating is dissolved, said coating thus preventing necking down and premature break-off of said anodic material at this critical point.

2. A water heater, comprising:

a tank including a wall defining an interior, said wall including corrodible material exposed to said interior;

an inlet for introducing water into said tank;

means for heating water in said tank;

an outlet for discharging hot water from said tank; and a coated anode mounted in said interior for protecting exposed areas of said corrodible material from corrosion by hot water stored in said tank, said anode including an uncoated portion of active anode metal over its lower end away from the tank connection, and a coated top portion adjacent to this connection, said coated portion including an inner layer of anodic material, an intermediate layer of anode/coating reaction products, and an outer layer of cured coating, said coating being coated over said anodic material to substantially reduce electrochemical activity of said anodic material in said coated portion and conserve said anodic material in said coated portion for use at a future time when said coating has dissolved and after the uncoated portion of the anode has been largely used up at a slower rate protecting said exposed corrodible metal in the tank head, and said corrodible metal's reactivity with hot water has been reduced from prolonged service, said coating thus extending overall anode life well beyond that of a conventional uncoated anode by a second mechanism besides protection from necking and premature break-off.

3. A water heater as set forth in claim 2, wherein said exposed areas of corrodible material in the tank head and walls, as well as the anode top, are also covered with coatings to further reduce protection they draw from the anode by virtue of said coating's insulative behavior which reduces corrosion rates of said exposed corrodible material, thus further reducing anode usage and extending said anode's life.

4. A water heater as set forth in claim 2, wherein said anode further includes an uncoated portion adjacent to said coated portion, said uncoated portion consisting of anodic material to cathodically protect areas of exposed corrodible material in the tank wall and head at low usage rates because of its greater distance from them until the coated portion dissolves to release its full activity.

5. A water heater as set forth in claim 2, wherein said coating is slowly dissolvable over an extended period of contact with the water to slowly expose said anodic material in said coated portion which anodic material is normally more active than the lower uncoated portion by virtue of its closer proximity to large amounts of exposed corrodible material in the tank head, until said coated portion once again generates the high levels of cathodic protection normally found in said uncoated lower portion of said anode, thus distributing electrochemical activity more evenly over said anode's length and extending life of the said coated portion of the anode well beyond that of the lower uncoated area.

6. A water heater as set forth in claim 2, wherein said anode coating with a higher permeability, by virtue of its thinness or inclusion of soluble particles, is applied to the entire anodic material to moderate excessive activity of said anodic material caused by aggressive waters, and so extend its life in these difficult conditions, yet such higher permeability coating still allowing enough electrochemical activity to protect said corrodible material in the tank wall from excessive corrosion by said aggressive waters, said excessive activity being known to prematurely use up said anodic material by being converted into flammable gases or insoluble oxides instead of cathodic protection or into objectionable odors which interfere with anode and water heater operation, said total anode coatings thus increasing the anodic material's life.

7. A water heater as set forth in claim 2, wherein said coating is formed of an alkyl silicate material which has been cured to a semi-soluble inorganic oxide or an aluminum salt.

8. A water heater as set forth in claim 7, wherein said alkyl silicate material is selected from the group consisting of: methyl silicate, ethyl silicate, propyl silicate, and combinations thereof.

9. A water heater as set forth in claim 8, wherein said alkyl silicate material is ethyl silicate.

10. A water heater as set forth in claim 2, wherein said coating material is an alkali metal silicate solution, which is a conversion layer of reaction products of the coating material and said anodic material, and where excess alkali silicate coating material left on the surface is either heat cured to a less soluble form or rinsed off the surface to leave the more insoluble conversion layer to reduce anode activity.

11. A water heater as set forth in claim 10, wherein said alkali metal silicates are selected from the group consisting of: lithium silicate, potassium silicate, sodium silicate, and combinations thereof.

12. A water heater as set forth in claim 10, wherein said coating further includes particles consisting of said anodic material, and said coating is also applied over said exposed corrodible material to improve the efficiency of electrolytically depositing coating and anodic material byproducts on said exposed areas of corrodible material in the tank wall and head to reduce corrosion rates at these areas and thereby further increase life of said anodic material and protection of its connection to the tank.

13. A water heater as set forth in claim 10, wherein said corrodible material is carbon steel, and wherein said tank wall further includes a layer of glass, said glass preventing a major portion of said corrodible material from contacting the water.

14. A water heater as set forth in claim 2, wherein said coating is selected from the group consisting of: polysaccharides, starches and high molecular weight condensation polymers.

15. A water heater as set forth in claim 2, wherein said coating further includes particles which moderate the electrochemical activity of the anodic material or improve the performance of said silicate coatings to form insulating layers on exposed corrodible material in the tank wall and head, and so more effectively inhibit corrosion in these areas, thereby reducing anode usage even more and increasing its life.

16. A water heater as set forth in claim 15, wherein said particles are selected from the group consisting of: ceramic particles, inorganic particles, metal particles and combinations thereof, said metal particles including highly purified and electrochemically active aluminum and zinc particles of such type as are normally used for the rod of said anodic materials themselves in the tank.

17. A water heater as set forth in claim 2, wherein said coating interacts with water to produce byproducts which are electrolytically deposited or otherwise form insulating films on said anodic material and said areas of exposed corrodible material to reduce their mutual interaction and thereby increase anode life and prevent its necking down and premature break-off.

18. A water heater as set forth in claim 2, wherein said coating further includes particles of filler materials to increase the thickness of said coatings on said anodic material and so further reduce the electrochemical activity of said anodic material to increase its service life, said filler materials thereby also increasing the useful effects of said coatings in reducing corrosion rates of said exposed corrodible material in the tank wall and head.

19. A water heater as set forth in claim 18, wherein said filler materials are selected from the group consisting of clays and diatomaceous earth particles.

20. A water heater as in claim 2, where the inner, intermediate and outer layer are applied both to said anodic material and exposed corrodible material in the tank head.

21. A water heater, comprising:

a tank including a wall defining an interior, said wall including corrodible material exposed to said interior;

an inlet for introducing water into said tank;

an electric heating element mounted in said tank for heating water in said tank, said electric heating element including corrodible material;

an outlet for discharging hot water from said tank; and an anode mounted in said interior for protecting said corrodible material from corrosion by hot water of the tank, said anode including an uncoated portion consisting of anodic material, said anode including a coated portion near said heating elements, said coated portion including an inner layer of anodic material, an intermediate layer of coating material and anodic material reaction products, and an outer layer of cured coating, said coating including particles of said anodic material, said coating being coated over said anodic material to substantially reduce electrochemical attack by the strong electrical fields associated with said heating elements on said anodic material in said coated portion and conserve said anodic material in said coated portion and so distribute said electrochemical attack on said anodic material more uniformly over its surface, thereby extending the life of said anodic material near such strong electric fields.

22. A water heater as set forth in claim 21, wherein said electric heating element further includes a coating similar to that used on said anodic material, said coating including particles of said anodic material whose byproducts along with those of said coating's, insulate said electric heating element, and so further reduce its absorption of cathodic protection, thus increasing said anodic material's life even more, said coating having a substantial service life at the extreme temperatures present on said heating elements because of said coating's exceptional heat resistance.

23. A water heater, comprising:

a tank including a wall defining an interior, said wall including corrodible material exposed to said interior;

an inlet for introducing water into said tank;

means for heating water in said tank;

an outlet for discharging hot water from said tank; and an anode mounted in said interior for protecting said corrodible material from electrochemical corrosion by hot water stored in said tank, said anode including an inner layer of anodic material and an outer layer of an activating coating, said anodic material having an electrochemical activity which is insufficient to protect said corrodible material from excessive corrosion, and said activating coating being coated over certain areas of said anodic material to increase the electrochemical activity at these areas only to a level sufficient to prevent excessive corrosion of said corrodible material without increasing said anode's activity near its connection to the tank, so that necking and premature break-off are limited by the anode material's own low activity there.

24. A water heater as set forth in claim 23, wherein said anode includes spaced ends, wherein said anode is attached to said tank at one of said ends, and wherein said activating coating is applied over two thirds of said anodic material at the opposite spaced end to activate that part of said anode away from its connection to the tank only and thus preserve said connection from necking.

25. A water heater as set forth in claim 23, wherein said anodic material is low cost aluminum alloy or low purity zinc metal, which anodic materials normally are not usable because they form oxide films in hot water which inhibit their activity, and said activating coating is a mixture of high purity aluminum particles in a binder of my alkyl silicate coatings.

* * * * *